United States Patent [19]

Martin et al.

[11] 4,356,604

[45] Nov. 2, 1982

[54] PROCESS FOR THREADING UP A RAPIDLY TRAVELLING THREAD IN A TEXTURIZING NOZZLE

[75] Inventors: Wolfgang Martin; Hans Knopp, both of Ludwigshafen; Dieter Herion, Frankenthal; Gerhard Conzelmann, Otterstadt; Guenter Leuchtmann, Mannheim, all of Fed. Rep. of Germany; Peter Gujer, Winterthur, Switzerland; Dieter Guldenfels, Dinhard, Switzerland; Armin Wirz, Ossingen, Switzerland

[73] Assignee: BASF Farben & Fasern AG, Hamburg, Fed. Rep. of Germany

[21] Appl. No.: 230,355

[22] Filed: Jan. 30, 1981

Related U.S. Application Data

[62] Division of Ser. No. 25,173, Mar. 29, 1979, Pat. No. 4,280,260.

[30] Foreign Application Priority Data

Apr. 21, 1978 [DE] Fed. Rep. of Germany ..... 2817478

[51] Int. Cl.[3] ..... D02G 1/12

[52] U.S. Cl. ..... 28/255; 28/257; 28/272

[58] Field of Search ..... 28/255, 256, 257, 272; 226/7, 97

[56] References Cited

U.S. PATENT DOCUMENTS

| | | | |
|---|---|---|---|
| 3,094,262 | 6/1963 | Ashby et al. . | |
| 3,423,000 | 1/1969 | Heinen | 226/97 |
| 3,577,614 | 5/1971 | Price . | |
| 3,577,721 | 5/1971 | Schmick . | |
| 3,802,036 | 4/1974 | Parks | 28/272 |
| 3,837,052 | 9/1974 | Martin et al. | 28/272 |
| 3,908,248 | 9/1975 | Schmid et al. | 28/255 |
| 3,970,231 | 7/1976 | Strutz et al. . | |
| 3,982,412 | 9/1976 | Isoard et al. . | |
| 3,986,325 | 10/1976 | Ritter et al. | 226/97 X |
| 4,051,581 | 10/1977 | Biot | 28/272 |
| 4,073,421 | 2/1978 | Reufer | 28/272 X |
| 4,096,226 | 6/1978 | Martin et al. . | |

FOREIGN PATENT DOCUMENTS

| | | | |
|---|---|---|---|
| 2331248 | 3/1970 | Fed. Rep. of Germany . | |
| 2339603 | 4/1971 | Fed. Rep. of Germany . | |
| 2625290 | 6/1972 | Fed. Rep. of Germany . | |
| 2708102 | 8/1978 | Fed. Rep. of Germany | 28/272 |
| WO79/00956 | 11/1979 | PCT Int'l Appl. | 28/257 |

*Primary Examiner*—Robert Mackey

*Attorney, Agent, or Firm*—Keil & Witherspoon

[57] ABSTRACT

A process for introducing one or more threads into a texturizing nozzle, in which the texturizing nozzle, together with the inlet member, is first brought into a position in which the thread is led transversely past and in the immediate vicinity of the texturizing nozzle, the thread is sucked against the nozzle with the orifice of the inlet member enlarged, immediately after being sucked against the texturizing nozzle the thread is cut beyond the nozzle so that the cut end is sucked back into the nozzle, the suction supply required for the sucking-in is replaced by pressurized fluid texturizing medium, and the cross-section of the inlet orifice of the texturizing device is reduced to a value advantageous for steady state operation.

An apparatus for carrying out the above process, comprising a pivotable texturizing nozzle with an inlet member of variable cross-section, and a suction device which permits the pressure to be reduced, relative to atmospheric pressure, at the inlet member of the texturizing nozzle, is also disclosed.

2 Claims, 8 Drawing Figures

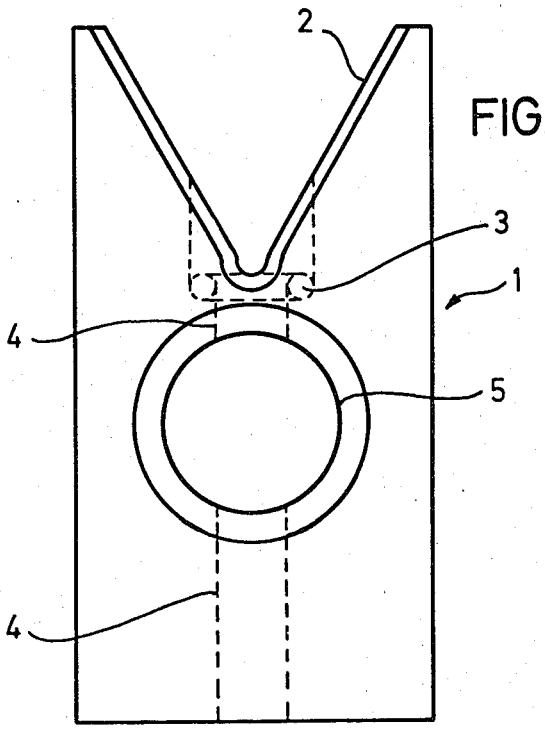
FIG.1
FIG.2
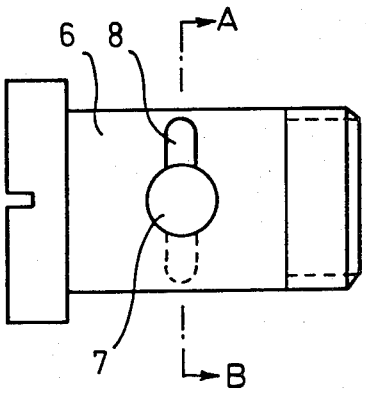
FIG.2a
A-B
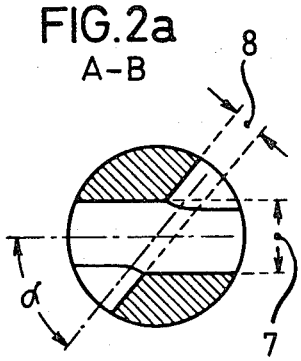

PROCESS FOR THREADING UP A RAPIDLY TRAVELLING THREAD IN A TEXTURIZING NOZZLE

This is a division of application Ser. No. 25,173, filed Mar. 29, 1979, now U.S. Pat. No. 4,280,260.

In fluid-jet texturizing, one or more threads are conveyed, by means of a conveying or texturizing fluid medium (usually hot air), through a texturizing nozzle, and become texturized. In this process, in particular in one-step spin-draw texturizing, the threading up or introduction of the thread or threads is a difficult problem. The thread can be sucked into the texturizing nozzle under reduced pressure, and after the thread has been sucked in the nozzle is changed over to steady state operation, i.e. the thread or threads are conveyed through the nozzle with a large amount of conveying or texturizing medium. At the desired high speed of 2,000 m/min or more, the threading-up process entails substantial wastage of yarn. There have therefore been many attempts to simplify the threading-up process and reduce the time it requires.

German Laid-Open Application DOS No. 2,339,603 describes a process in which, for threading up, the inlet orifice of the nozzle is enlarged, and is subsequently reduced for steady state operation. This process employs a device in which the inlet orifice is enlarged by removing an inner body and reduced by inserting the inner body. The device is of rather complicated construction, because of the movable inner body. It therefore requires considerable manual skill to effect the threading up very rapidly. German Laid-Open Application DOS No. 2,625,290 discloses a process for introducing a yarn into a pneumatic texturizing apparatus, in which the yarn is placed in front of the inlet orifice of the apparatus, at right angles to the axis of the latter, and is cut so that a loop is formed under the sole action of a fluid under pressure, and this loop is driven by the fluid into the inlet orifice.

German Laid-Open Application DOS No. 1,660,671 discloses an apparatus for facilitating bobbin changes, in which a blowing nozzle and a suction nozzle cooperate.

We have found that in the threading up or introduction of one or more threads into a fluid-jet texturizing nozzle, in which the cross-section of the inlet orifice of the texturizing nozzle is enlarged, prior to introduction of the thread, relative to its size in steady state operation, the thread is sucked into the nozzle and thereafter the thread inlet orifice is reduced to the cross-section in steady state operation, can be carried out particularly simply and rapidly if the texturizing nozzle, together with the inlet member, is first brought into a position in which the thread is at least approximately at right angles to the axis of the inlet orifice in the immediate vicinity of the inlet member of the texturizing nozzle, the thread is sucked against the nozzle with the orifice of the inlet member enlarged, immediately after being sucked against the texturizing nozzle the thread is cut off beyond the nozzle so that the cut end is drawn into the nozzle, suction to the texturizing nozzle is replaced by pressurized texturizing medium and the cross-section of the orifice of the inlet member upstream of the texturizing nozzle is reduced to a value advantageous for steady state operation, and the texturizing nozzle is brought into the appropriate position for steady state operation.

The process may be carried out with jet-texturizing nozzles of which a plurality have previously been disclosed. For example, those disclosed in East German Pat. No. 17,786 or in U.S. Pat. No. 3,373,470 may be used. The process is particularly suitable for threading up the apparatuses disclosed in U.S. Pat. Nos. 3,714,686 and 3,908,248. These nozzles are provided with a suitable inlet member, which permits varying the cross-section of the inlet nozzle. For example, the apparatus disclosed in German Published Application DOS No. 2,339,603 can be used; however, because of the inherently complicated mechanisms, its technical design becomes difficult since the texturizing nozzle must be pivotable together with the inlet member.

BRIEF DESCRIPTION OF THE DRAWINGS

The invention is further illustrated by reference to FIGS. 1 to 6 of the accompanying drawings.

FIG. 1 diagrammatically illustrates the inlet member.

FIGS. 2 and 2*a* diagrammatically illustrate a cylindrical plug rotatable in the manner of a stopcock in the inlet member.

DETAILED DESCRIPTION OF THE INVENTION

Figure 3:
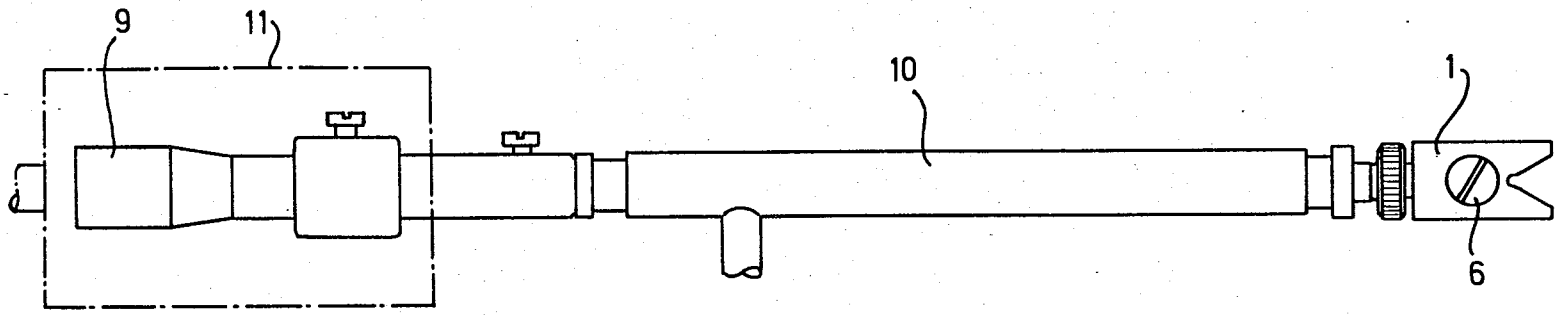
FIG. 3 diagrammatically illustrates the complete nozzle with the inlet member and a reduced pressure chamber.

The inlet member 1 shown diagrammatically in FIG. 1 is simpler. It possesses an inlet 2, tapering inwardly, in the shape of a wedge, from one end face and leading to an inlet ring 3. The internal diameter of this inlet ring corresponds to the diameter of the needle for introducing the yarn into the jet-texturizing nozzle. With the conventional total deniers of 1,000–3,000 dtex, an advantageous diameter is from 2.0 to 3.0 mm. Since the texturizing apparatus can also be run with 2 to 4 threads, i.e. two to four yarns of the stated total denier can be introduced, even larger diameters, for example up to 6.0 mm, of the inlet ring may be suitable. From the inlet ring 3, a yarn guide tube 4 leads to the needle for introducing the yarn, which needle is in the jet-texturizing nozzle and is not shown in the drawings. The yarn guide tube 4 is intersected by a vertical bore 5. A bored cylindrical plug 6, rotatable in the manner of a stopcock, is seated in this bore 5. By turning this stopcock, the cross-section of the orifice provided for flow may be varied. It is advantageous to construct the bore in the manner shown in FIGS. 2 and 2*a*; this bore results if the cylindrical stopcock 6 is centrally provided with a larger cylindrical bore 7 and a smaller cylindrical bore 8, positioned at an angle $\alpha$ of 20°–90°, preferably 40°–60°, to the larger cylindrical bore, the web between the two bores 7 and 8 being removed so that in total a pear-shaped or egg-shaped perforation results, in which, because the perforation is at an angle, a reflection of the orifice on the surface of the cylinder 6 results. Hence, when the texturizing nozzle is in full operation, the free cross-section of the yarn in the tube can be varied by turning the cylindrical stopcock 6 in the bore 5. The larger diameter of cylindrical bore 7 should not be greater than the internal diameter of the inlet ring 3. The smaller diameter of cylindrical bore 8 also depends on the denier and is about 0.2–0.6 times, preferably 0.3–0.5 times, the diameter of cylindrical bore 7.

In the apparatus according to the invention, the end 9 of the texturizing nozzle 10 is surrounded by a reduced pressure chamber 11, as shown diagrammatically in FIG. 3. The end of the texturizing nozzle means the region of the jet-texturizing nozzle in which the flowing texturizing medium can escape laterally. This end 9 is surrounded by a reduced pressure chamber 11, which is either in a fixed position, in which case it is advantageous if it can be folded open, or can be pushed manually over the end of the texturizing nozzle. This reduced pressure chamber is connected to any suitable suction apparatus, for example a suction gun. If the reduced pressure chamber 11 is stationary, it must be possible to open it, by folding open, and again close it so that the end of the texturizing nozzle is surrounded vacuum-tight by the chamber. It is advantageous if the reduced pressure chamber is of reasonable size, for example if it has a volume which is from 2 to 20 times, preferably from 4 to 10 times, the volume of the empty texturizing nozzle (excluding the slits), because it is only in that case that the thread or threads are sufficiently sucked against the device; alternatively, the suction rate would have to be rather high. The apparatus should make it possible to set up a pressure of from 300 to 700 mbar, preferably from 400 to 650 mbar, at the inlet ring 3.

Figure 4:
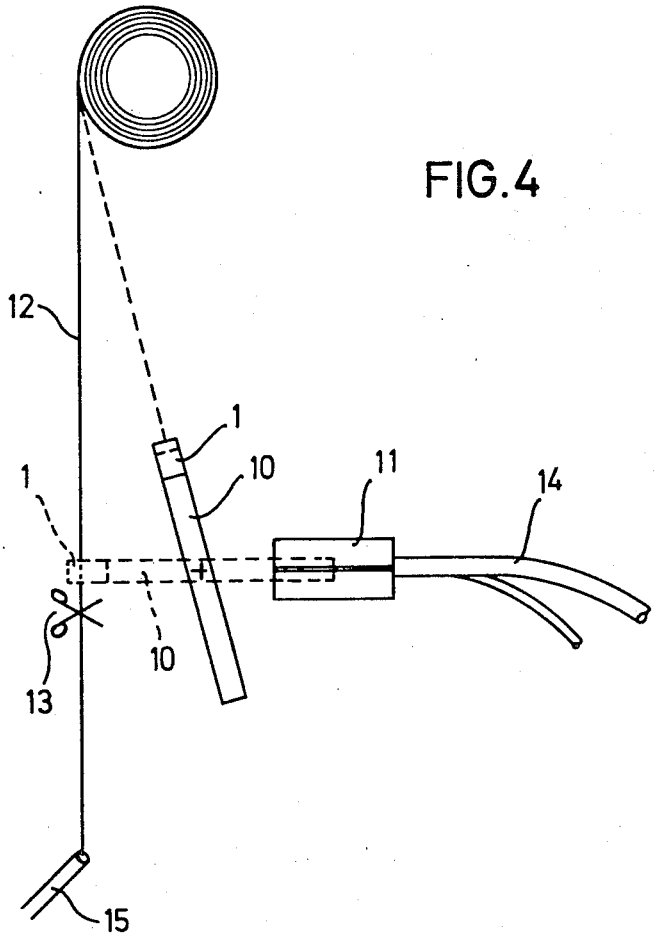
FIG. 4 diagrammatically illustrates the device for threading up a thread into a texturizing nozzle, and the nozzle itself in a usual working position.

FIG. 4 illustrates, by way of example, the introduction of the thread into the texturizing nozzle:

The texturizing nozzle 10, together with its inlet member 1, is first brought into a position at right angles to a thread 12 coming from a godet. The reduced pressure chamber 11 is placed on the end of the texturizing nozzle. As a result of the reduced pressure—advantageously after stopping the feed of texturizing medium by means of a valve—the thread is sucked against the inlet ring 3 (not shown in FIG. 4), with the yarn guide tube set to its large orifice. Immediately after the thread has been sucked against the inlet ring, the thread is cut below the texturizing nozzle 10, by means of scissors 13, which preferably are automatic. As a result of the reduced pressure in the reduced pressure chamber surrounding the outlet end of the texturizing nozzle, the thread is sucked into the inlet member. Advantageously, the thread is transiently picked up by means of a suction gun 15. The cross-section of the yarn guide tube in the inlet member is then reduced, for example by turning the cylindrical stopcock 6 (compare FIG. 2). The reduced pressure chamber is opened or removed. The texturizing nozzle is pivoted into the working position and the texturizing medium is fed to the nozzle at the full rate. This completes the threading-up operation and texturizing of the thread on the godet can continue.

Figure 6:
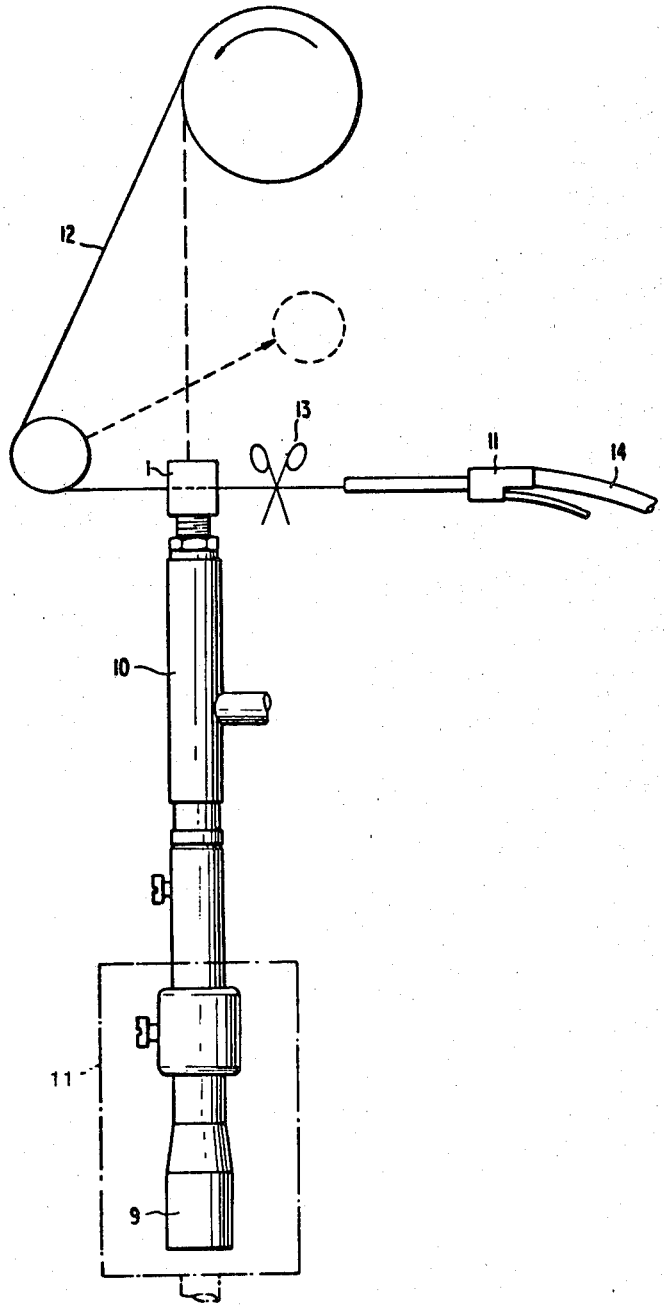
FIG. 6 diagrammatically illustrates the device for threading up a thread into a texturizing nozzle, using a fixed texturizing nozzle and guiding the thread so that it turns through a right angle on its way to the texturizing nozzle.

It is also possible, instead of pivoting the texturizing nozzle toward the thread source, to use a fixed texturizing nozzle and to guide the thread so that it turns through a right angle on its way to the texturizing nozzle (note FIG. 6).

Figure 5:
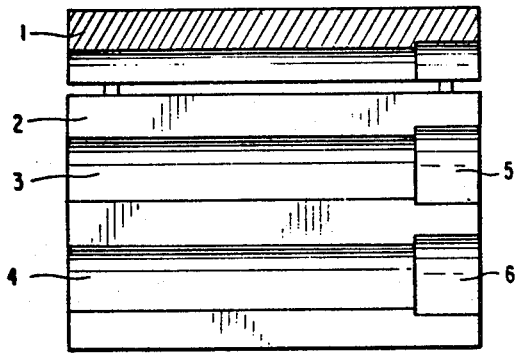
FIGS. 5 and 5A diagrammatically illustrate the basic structure of a reduced pressure chamber in the open state in a front and side elevation.
Figure 5A:
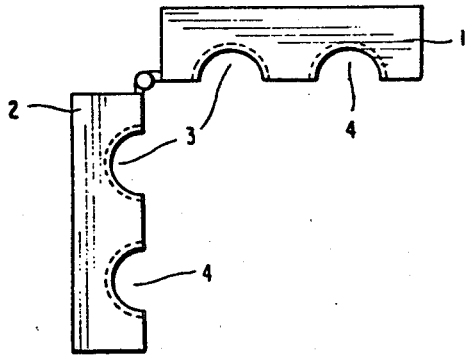

As mentioned, the process can be applied to single-thread and multi-thread operation. The reduced pressure chamber 11 can also be designed so as to encompass several texturizing nozzles conjointly (note FIGS. 5, 5*a*).

EXAMPLE

An unstretched nylon-6 yarn having a total denier of 3,900 den and comprising 67 individual filaments is picked up directly from the spinning apparatus by means of a high-performance suction gun 15 and is passed over a finish applicator, a yarn supply unit and a stretching unit. The temperature of the inlet godet of the stretching zone is 60° C. and the temperature of the outlet godet is 160° C. The preheated thread, stretched in the ratio of 1:3.10, is presented, at a speed of 2,000 m/min, to the texturizing apparatus 10 (FIG. 4), which is in the threading-up position. The thread tension created by means of the suction gun 14 in the region of the inlet member 1 is 100 g. The minimum diameter of the yarn guide tube 4 in the inlet member 1 at the time of threading up is 2.4 mm (bore 7, FIG. 2*a*) and is reduced manually to 1.0 mm (bore 8, FIGS. 2 and 2*a*) after threading up and after pivoting the texturizing apparatus 10 into the texturizing position (shown in full lines in FIG. 4). At the time of threading up, the reduced pressure in the texturizing apparatus 10 is 775 mbar. After reducing the inlet orifice, air at 300° C. is introduced into the apparatus 10 under a pressure of 5.8 bar. After steady-state conditions have been attained, the yarn is fed by means of the suction gun 14 to a downstream machine element. The threading-up operation requires about 2 minutes.

We claim:

1. A process for introducing at least one thread into a fluid-jet texturizing nozzle, comprising:

enlarging the cross-section of a thread inlet orifice of the texturizing nozzle compared to the cross-section in steady state operation prior to introduction of the thread, bringing the texturizing nozzle into a position in which the thread is at least approximately at right angles to the axis of the enlarged thread inlet orifice in the immediately vicinity of the texturizing nozzle, sucking the thread against the enlarged thread inlet orifice of the texturizing nozzle, immediately cutting the thread off beyond the texturizing nozzle so that the cut end is drawn into the texturizing nozzle, replacing suction to the texturizing nozzle by pressurized texturizing medium, bringing the texturizing nozzle into the working position for texturizing, and reducing the cross-section of the thread inlet orifice of the texturizing nozzle to a value advantageous for steady state operation.

2. A process as set forth in claim 1, wherein two to four threads are introduced into the fluid-jet texturizing nozzle.

* * * * *